US007914651B2

(12) United States Patent
Aslin et al.

(10) Patent No.: US 7,914,651 B2
(45) Date of Patent: Mar. 29, 2011

(54) REDUCING POWER CONSUMPTION IN ELECTRO-REFINING OR ELECTRO-WINNING OF METAL

(75) Inventors: Nigel James Aslin, Wulgura (AU); Wayne Keith Webb, Railway Estate (AU); Reville Wayne Armstrong, Annandale (AU); Tim Robinson, Scottsdale, AZ (US)

(73) Assignee: Mount Isa Mines Limited, Queensland (AU)

( * ) Notice: Subject to any disclaimer, the term of this patent is extended or adjusted under 35 U.S.C. 154(b) by 355 days.

(21) Appl. No.: 12/049,219

(22) Filed: Mar. 14, 2008

(65) Prior Publication Data

US 2008/0156655 A1 Jul. 3, 2008

Related U.S. Application Data

(63) Continuation of application No. 10/513,642, filed as application No. PCT/AU03/00519 on May 2, 2003, now Pat. No. 7,344,624.

(30) Foreign Application Priority Data

May 3, 2002 (AU) ..... PS2128

(51) Int. Cl.

| | |
|---|---|
| ***C25D 1/20*** | (2006.01) |
| ***C25B 9/02*** | (2006.01) |
| ***C25B 11/02*** | (2006.01) |
| ***C25B 11/04*** | (2006.01) |

(52) U.S. Cl. ..... 204/281; 204/286.1; 204/288.2; 204/289; 204/242; 204/224 R; 204/278.5; 205/575

(58) Field of Classification Search ..... 204/279, 204/281, 286.1, 288.2, 289, 224 R, 242, 278.5; 205/575

See application file for complete search history.

(56) References Cited

U.S. PATENT DOCUMENTS

| | | | |
|---|---|---|---|
| 4,186,074 | A | 1/1980 | Perry |
| 4,376,690 | A | 3/1983 | Kugler |
| 4,619,752 | A | 10/1986 | Koziol et al. |
| 4,882,027 | A | 11/1989 | Borst et al. |
| 6,131,798 | A | 10/2000 | Prengaman |
| 6,569,300 | B1 | 5/2003 | Assenmacher |

FOREIGN PATENT DOCUMENTS

| | | |
|---|---|---|
| DE | 4241485 | 3/1993 |
| FI | 105698 | 3/1999 |
| GB | 2 104 549 A | 3/1983 |
| GB | 2104549 | 3/1983 |
| WO | 0039366 | 7/2000 |

OTHER PUBLICATIONS

English-language Translation of the Finnish Office Action of Jun. 16, 2008 against Finnish patent application No. 20041407.

*Primary Examiner* — Bruce F Bell
(74) *Attorney, Agent, or Firm* — Novak Druce + Quigg LLP

(57) ABSTRACT

A cathode plate and method for electro-refining or electro-winning of metal. The cathode includes a cathode blade and hanger bar. A quantity of electrically conductive material is wrapped around the hanger bar and along the cathode blade to a position, in use, proximate the level of electrolyte in the electrolytic bath. The provision of a deeper and preferably thicker coating of electrically conductive material, as compared with conventional cathode plates, reduces power consumption in the electrolytic circuit.

26 Claims, 4 Drawing Sheets

REDUCING POWER CONSUMPTION IN ELECTRO-REFINING OR ELECTRO-WINNING OF METAL

This application is a continuation of U.S. patent application Ser. No. 10/513,642 filed Aug. 31, 2005 now U.S. Pat. No. 7,344,624 which is a §371 National Stage Application of International Application No. PCT/AU03/00519, filed on 2 May 2003, claiming the priority of Australian Patent Application No. PS2128 filed on 3 May 2002.

TECHNICAL FIELD

The present invention relates to methods and apparatus for electro-refining or electro-winning of metal.

BACKGROUND ART

The recovery or refining of metal by means of electrolytic techniques are well known.

One particularly well known technique is the ISA Process for electro-refining of copper and other metals. In this process, unrefined anodes of copper are placed in an electrolytic bath and separated by stainless steel cathode plates. Application of a current causes the unrefined copper to enter the electrolytic bath and subsequently deposit on the cathode. The thus refined copper is then mechanically stripped from the cathode for subsequent handling.

As will be understood by persons skilled in the art, the power requirements for large electro-refining or electro-winning operations are quite high and there have been various efforts in reducing power consumption. Most previous efforts in reducing power consumption have concentrated on producing a better connection between the stainless steel cathode plate and the hanger bar which supports and transmits currents to the cathode plate in the electrolytic bath. In some instances corrosion can occur between this join.

It is an object of the present invention to overcome or ameliorate at least one of the disadvantages of the prior art, or to provide a useful alternative.

DISCLOSURE OF THE INVENTION

In a broad aspect, the present invention provides a cathode plate for electro-refining or electro-winning of metal, the cathode plate comprising a cathode blade for deposition of metal thereon, a hanger bar attached along one edge of the cathode blade and adapted to support and transfer current to the cathode blade when placed in an electrolytic bath and a quantity of electrically conductive material extending downwardly from the hanger bar along the cathode blade to a position, in use, proximate the level of electrolyte in the electrolytic bath, said material having an electrical conductivity greater than said cathode blade.

Preferably, the quantity of electrically conductive material is applied as a coating or cladding over the upper end portion of a cathode plate connected to the hanger bar.

The term 'proximate' is a reference to the quantity of electrically conductive material being substantially closer to the level of electrolyte than conventional electro-refining or electro-winning cathode plates.

Of course, there will be variations in the depths of the electrolytic bath and these should be taken into consideration when determining the extent of the coating or cladding. In electro-refining environments, the cladding may extend from the hanger bar to the base of the lifting windows formed in the cathode plate. This would normally be around 30 to 40 mm above the electrolyte solution line with currently available solution level control techniques.

In electro-winning situations, the coating or cladding may extend beyond the lifting window but once again, it is preferable to terminate the coating or cladding around 30 to 40 mm above the acid mist suppression media.

It should be noted, however, that it is not necessary for the cathode plate to have lifting windows. The present cathode plate design is suitable for plates which have no lifting windows and are supported by means of, for examples, hooks on the hanger bar.

The Applicant's have surprisingly found that coating or cladding of electrically conductive material over the upper portion of the cathode plate substantially reduces the resistance to electrical flow formed by the stainless steel sheet. Reduction in cathode plate power consumption of up to 40% is anticipated in some environments depending upon the thickness of the coating or cladding, the type of electrically conductive coating or cladding material, eg copper and the proximity to the electrolyte solution lines.

Preferably, the electrically conductive material is between 2 to 4 mm thick and most preferably about 3 mm thick.

The electrically conductive material can be applied as a coating or cladding but is most preferably applied electrolytically. This is accomplished by simply inverting the cathode plate and placing the hanger bar and upper portion of the cathode blade in a suitable electrolytic coating apparatus. This has another advantage in that consistency of coating between the hanger bar and cathode blade can be achieved.

In a second aspect, the present invention provides a method of reducing power consumption of a cathode plate in electro-refining or electro-winning of metal, said cathode plate comprising a cathode blade for deposition of metal thereon and a hanger bar attached to an edge of the cathode blade for supporting and transmitting current to a cathode blade in an electrolytic bath, said method comprising providing a quantity of electrically conductive material extending downwardly from the hanger bar along the cathode blade to a position, in use, proximate the level of electrolyte in the electrolytic bath, said material having electrical conductivity greater than said cathode blade.

In a third aspect, the present invention provides a method of reducing power consumption of an electro-refining or electro-winning circuit having a series of cathode plates, each plate having a cathode plate for deposition of metal thereon and a hanger bar attached along one edge of the cathode blade adapted to support and transfer current to the cathode blade when placed in an electrolytic bath.

said method comprising incorporating into one or more of the cathode plates, a quantity of electrically conductive material extending downwardly from the hanger bar along the cathode blade to a position, in use, proximate the level of electrolyte in the is electrolytic bath, said material having an electrical conductivity greater than said cathode blade.

BRIEF DESCRIPTION OF THE DRAWINGS

The present invention will now be described by way of example only with reference to the accompanying drawings in which.

BEST MODE FOR CARRYING OUT THE INVENTION

Figure 1:
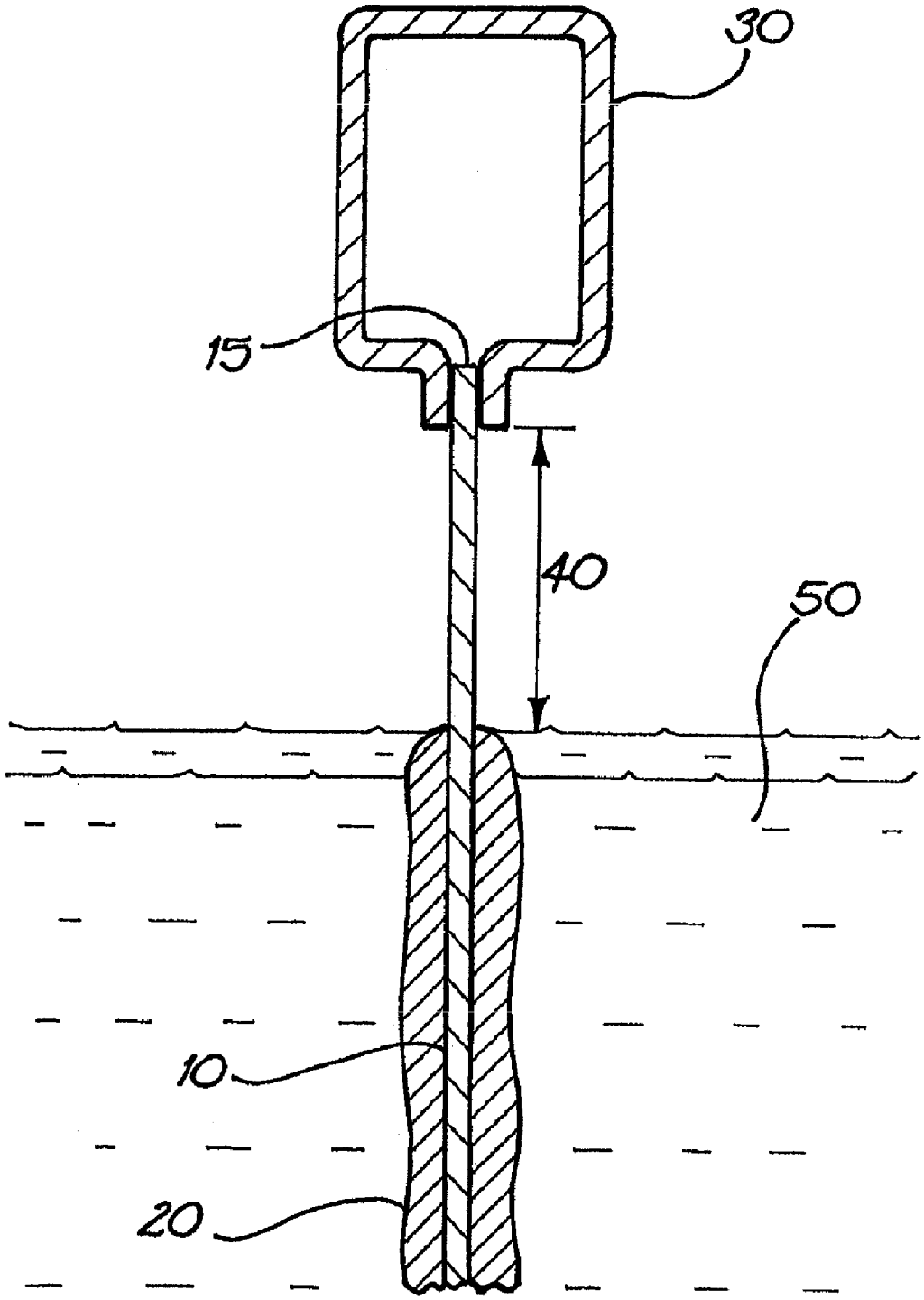
FIG. 1 (Prior Art)
FIG. 1 is a cross sectional view of a conventional cathode plate in use.

Turning firstly to FIG. 1, it will be seen that the cathode plate 1 comprises cathode blade 10 on which the metal 20 may be deposited. In the ISA Process, cathode blade 10 is constructed from stainless steel normally 316L. The hanger bar 30 is conducted along the upper end edge 15 of the cathode plate. In use this hanger bar supports cathode blade 10 in the electrolytic bath 50 and transmits current to the plate 10. In the embodiments shown, the hanger bar comprises a hollow stainless steel hanger bar coated or clad with an electrically conductive material such as copper with a thickness of around 2.5 mm. The present invention works equally well with other forms of hanger bar, eg solid copper hanger bars.

Most previous efforts in reducing power consumption of cathode plates have concentrated on improving the quality and/or corrosion resistance of the cathode blade to hanger bar joint.

The present Applicant's took a totally different approach to reducing power consumption of the cathode plate. It was hypothesised that it may be possible to reduce power consumption by reducing the electrical resistance of that portion 40 of the stainless steel blade 10 exposed above the line of electrolyte in the bath.

Figure 2:
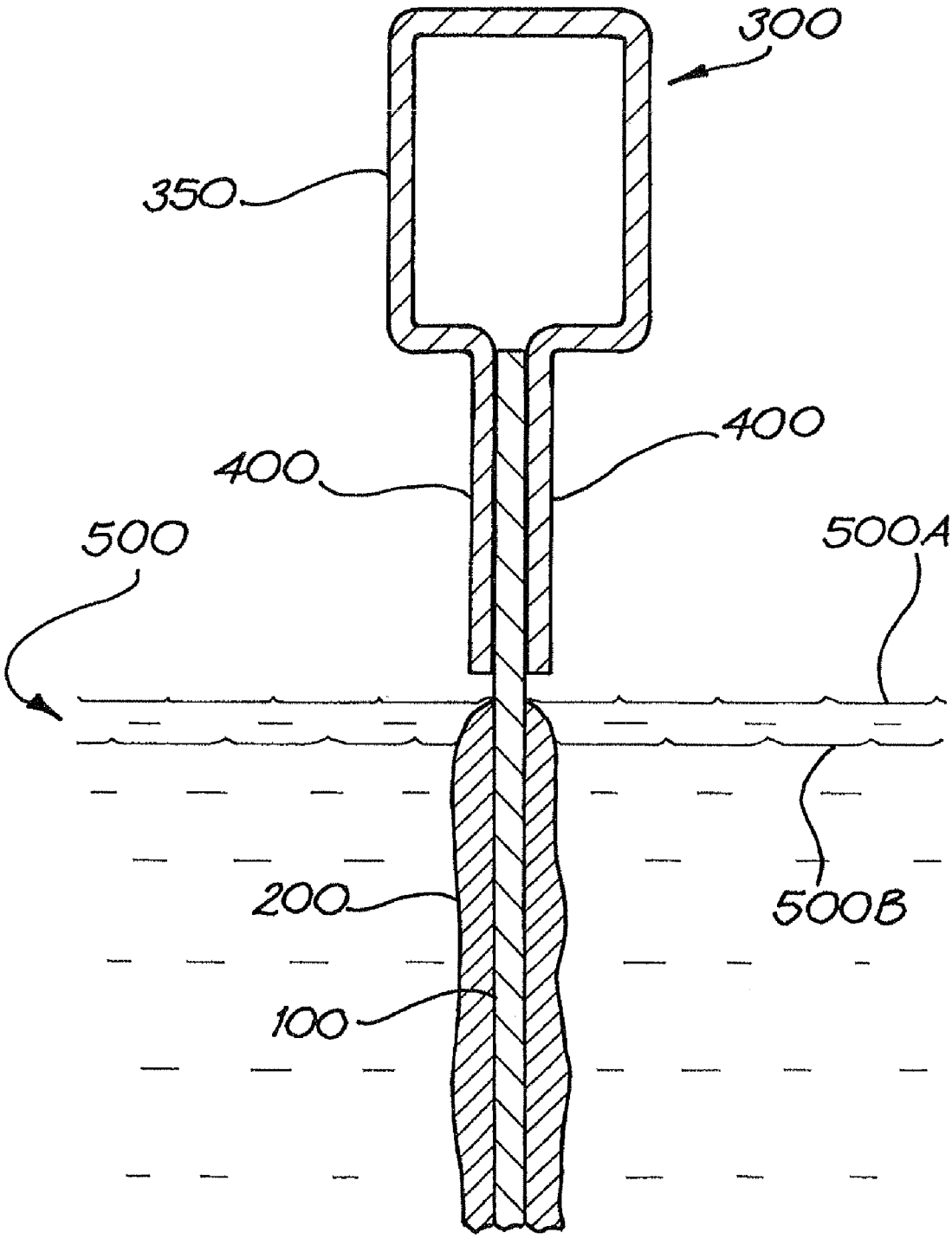
FIG. 2 is a cross sectional view of a cathode plate in use.

Referring to FIG. 2, the cathode plate 2 according to the present invention comprises cathode blade 100 connected along its upper end portion to hanger bar 300. As with FIG. 1, the hanger bar is shown as a hollow bar clad with an electrically conductive material 350, eg copper preferably to a thickness of around 3 mm. In accordance with the present invention, additional electrically conductive material 400 extends between the blade 100 and hanger bar 300. In this instance, a coating or cladding of electrically conductive material is provided along the upper portion of the cathode blade extending between the hanger bar and a position proximate the solution line 500 of the electrolytic bath.

It should be noted that the depth of the electrolyte in the bath will vary slightly. The upper and lower depth 500A and 500B should be calculated when determining the extent of the coating or cladding 400.

The Applicant's have found that the electrical resistance and therefore power consumption of the cathode can be substantially reduced by covering that part of the cathode plate exposed above the electrolytic bath.

The standard ISA PROCESS permanent cathode is electroplated with copper to approximately 15 mm down onto the blade. This ensures even flow of current into the blade and a more even initiation of the copper deposit.

The Applicant has now developed a low resistance cathode by depositing the copper farther down the blade. Subsequent calculations highlighted the impact of increasing the depth of the copper plating. An 11 μΩ per plate decrease in resistance with the copper coating down to the windows was calculated. The results showed that the further down the blade the copper coating the greater the potential energy savings.

The cathode design differs from the standard design in two ways:

- The copper plating extends approximately 55 mm down the blade compared to 15-17 mm.
- Increased average copper thickness of 3.0 mm compared to 2.5 mm.

The benefits of this new "high electrical performance cathode" are:

- Extension of the copper plating reduces the amount of electrical resistance that exists between the copper plating and the solution line by reducing the distance the current has to travel through the stainless steel.
- Increasing the thickness of the copper deposit provides greater corrosion resistance, particularly in electrowinning applications where cathodes are subjected to operating practices which can be detrimental to the cathode plate life.

The coating or cladding 400 should have an electrical conductivity substantially greater than that of the cathode blade 100. In the embodiments shown, the cathode blade 100 is produced from stainless steel 316L and the coating or cladding 400 is produced from copper. The coating or cladding 400 may be applied as an electrodeposited coating or as a mechanical, eg welded, attachment over the stainless steel between the hanger bar and the solution line.

A full cell load of trial plates were manufactured to the proposed design and placed into service at a suitable test site.

While these cathode plates were in operation their electrical performance was monitored. Current distribution and internal plate resistance measurements were recorded on a regular basis.

Figure 3:
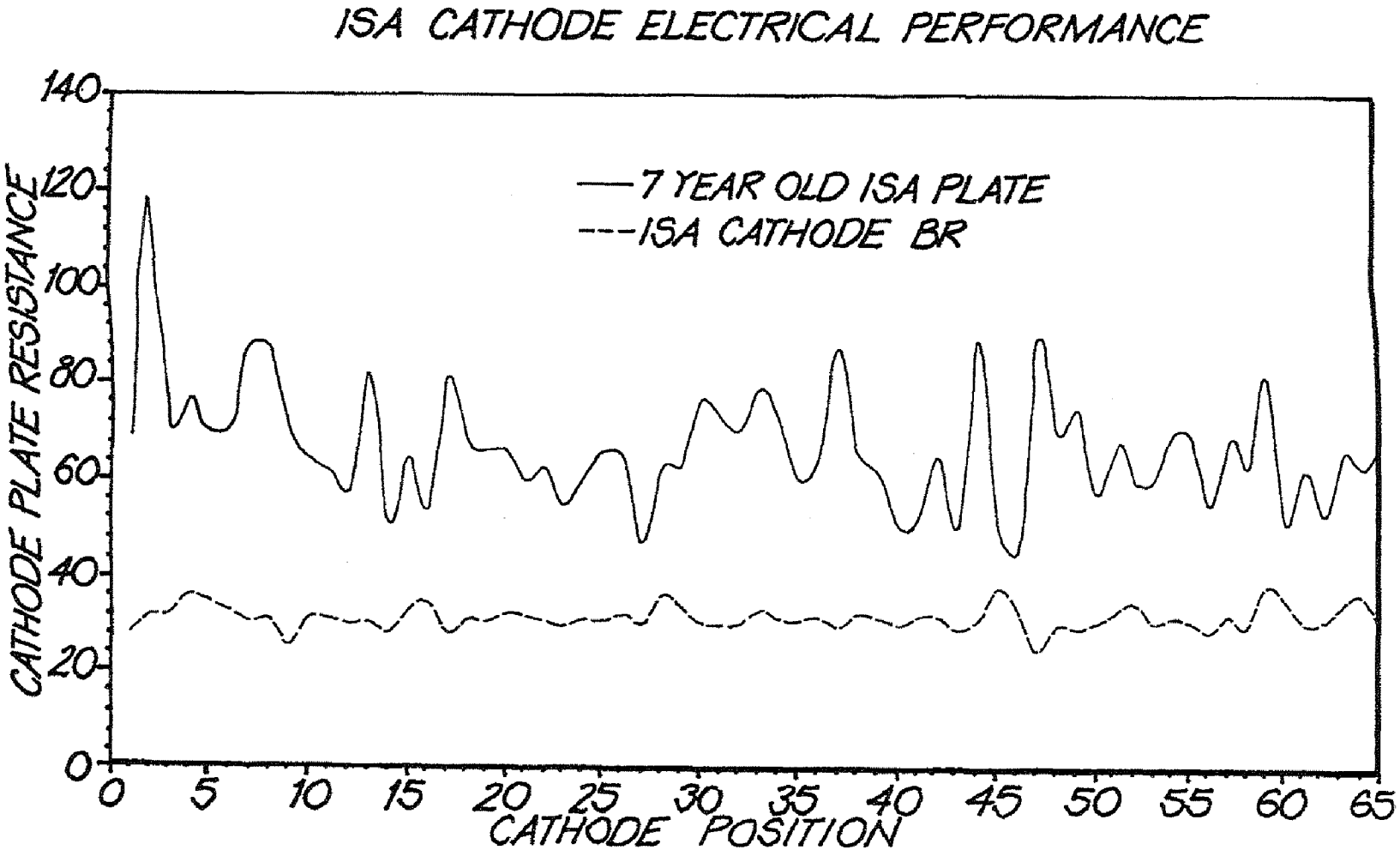
FIG. 3 is a graphical representation illustrating the difference between a conventional cathode plate and a cathode plate in accordance with the present invention.

The potential difference between the hanger bar and solution line was measured which enabled the internal plate resistance to be calculated. The results indicate that proposed cathode plate design is a lower resistance cathode plate in comparison with conventional ISA cathodes approximately 7 years old. FIG. 3 highlights the difference in performance of the new cathode design with the older style cathode.

Figure 4:
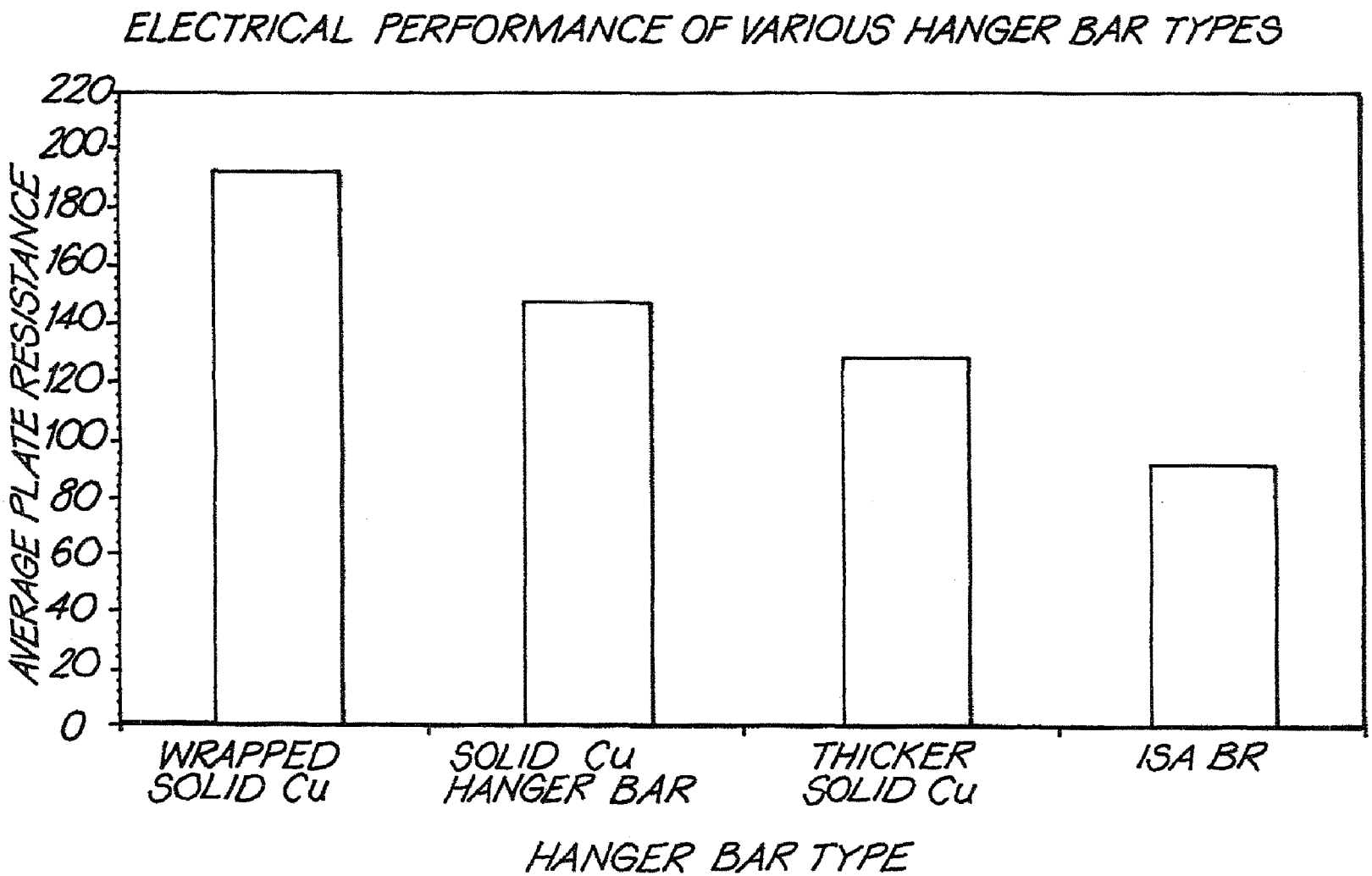
FIG. 4 is a further graphical representation of the internal resistance of various types of cathode plates including the cathode plate of the present invention.

Further measurements were taken at the test site to compare the performance of a number of cathode plate designs. The results are illustrated in FIG. 4. The cathode types that were used in the comparison were as follows:

- New cathode plate design (ISA BR)
- Solid copper hanger bars (conventional)
- Thicker solid copper bars (conventional)
- Wrapped solid copper hanger bars (conventional)

The results from the last set of measurements taken at the test site clearly show that the new cathodes are electrically superior, exhibiting the lowest plate resistance.

Measurements recorded at the test site illustrate that the new cathode plate design has the potential to reduce their power costs by approximately US$100,000 per year in a plant of this size. This is the magnitude of saving that the new cathode plate design can provide due to their significantly lower plate resistance resulting from the increased depth of copper plating. This is in comparison conventional 7-year-old ISA cathodes and solid copper hanger bars. A full cell load containing the new cathode type was measured along with three other standard cells which contained seven-year-old ISA cathodes and solid copper hanger bars.

Calculations showing potential power savings

| | |
|---|---|
| Potential from contact to solution line | Average difference: 23 mV |
| Average current per cathode plate | 660 Amps |
| Power per cell | 989 Watts per cell |
| Total number of cells in plant | 368 |
| Power cost | US$ 0.032/kWh |
| Total power savings across the plant | 364 kW |

-continued

| | |
|---|---|
| Total power COST savings per year | US$102,036 |

As far as the limit of the depth of the coating 400 is concerned, it is important that the coating or cladding 400 does not connect to the metal 200 deposited on the cathode plate. Such a connection would make it extremely difficult to strip the deposited metal 200 from the cathode plate 100 in accordance with the ISA Process. Accordingly, a clearance should exist between the lower portion of the coating or cladding 400 and the solution line 500. In most cases, a clearance of around 30 to 40 mm is sufficient.

It will be understood that the method and apparatus for reducing power consumption in electro-refining or electro-winning metal can be embodied in forms other than that described herein without departing from the spirit or scope of the invention.

The invention claimed is:

1. A cathode plate for electro-refining or electro-winning of metal, the cathode plate comprising a cathode blade for deposition of metal thereon, a hanger bar attached along one edge of the cathode blade and adapted to support and transfer current to the cathode blade when placed in an electrolytic bath and a quantity of electrically conductive material extending downwardly from the hanger bar along the cathode blade to a position, in use, 30-40 mm above the level of the metal deposition area on the cathode blade the material having an electrical conductivity greater than the cathode blade.

2. A cathode plate as claimed in claim 1, wherein the quantity of electrically conductive material is applied as a coating or cladding over the upper end portion of the cathode blade connected to the hanger bar.

3. A cathode plate as claimed in claim 2, wherein the coating or cladding extends from the hanger bar to the base of lifting windows formed in the upper portion of the cathode blade.

4. An apparatus comprising the cathode plate as claimed in claim 2 and the electrolytic bath, the cathode plate being placed in the electrolytic bath, wherein the coating or cladding extends to a position about 30 to 40 mm above the level of electrolyte when the cathode plate is placed in the electrolytic bath.

5. An apparatus comprising the cathode plate as claimed in claim 2 and the electrolytic bath, the cathode plate being placed in the electrolytic bath, wherein the coating or cladding extends to a position, in use, about 30 to 40 mm above the acid mist suppression media of electrolytic bath.

6. A cathode plate as claimed in claim 1, wherein the electrically conductive material extends over the upper end portion of the cathode blade and the hanger bar.

7. A cathode plate as claimed in claim 1, wherein the quantity of electrically conductive material is applied as an electrolytic coating over the hanger bar and upper end portion of the cathode blade.

8. A cathode plate as claimed in claim 1, wherein the electrically conductive material is between 2 to 4 mm thick.

9. A cathode plate as claimed in claim 1, wherein the electrically conductive material is about 3 mm thick.

10. A cathode plate as claimed in claim 1, wherein the electrically conductive material is copper.

11. A cathode plate as claimed in claim 1, wherein the electrically conductive material is copper.

12. A method of reducing power consumption of a cathode plate in electro-refining or electro-winning of metal, the cathode plate comprising a cathode blade for deposition of metal thereon and a hanger bar attached to an edge of the cathode blade for supporting and transmitting current to a cathode blade in an electrolytic bath, the method comprising providing:

a quantity of electrically conductive material extending downwardly from the hanger bar along the cathode blade to a position, in use, proximate the level of electrolyte in the electrolytic bath, the material having electrical conductivity greater than the cathode blade, and wherein the electrical resistance of the electrically conductive material on the exposed portion of the cathode plate above the electrolyte is reduced yielding a reduction in power consumption.

13. A method as claimed in claim 12, further comprising applying the electrically conductive material as a coating or cladding over the upper end portion of the cathode blade connected to the hanger bar.

14. A method as claimed in claim 13, wherein the coating or cladding extends to a position about 30 to 40 mm above the level of electrolyte when the cathode plate is placed in the electrolytic bath.

15. A method as claimed in claim 13, wherein the coating or cladding extends to a position, in use, about 30 to 40 mm above the acid mist suppression media of the electrolytic bath.

16. A method as claimed in claim 12, further comprising applying the electrically conductive material over the upper end portion of the cathode blade and the hanger bar.

17. A method as claimed in claim 12, further comprising electrolytically applying the quantity of electrically conductive material.

18. A method as claimed in claim 12, further comprising electrolytically coating the hanger bar and upper end portion of the cathode blade with a quantity of electrically conductive material.

19. A method as claimed in claim 12, further comprising providing the electrically conductive material from the hanger bar to the base of lifting windows formed in the upper portion of the cathode blade.

20. A method as claimed in claim 12, wherein the electrically conductive material is between 2 to 4 mm thick.

21. A method as claimed in claim 12, wherein the electrically conductive material is about 3 mm thick.

22. A method of reducing power consumption of an electro-refining or electro-winning circuit having a series of cathode plates, each plate having a cathode plate for deposition of metal thereon and a hanger bar attached along one edge of the cathode blade adapted to support and transfer current to the cathode blade when placed in an electrolytic bath, said method comprising incorporating into one or more of the cathode plates, a quantity of electrically conductive material extending downwardly from the hanger bar along the cathode blade to a position, in use, proximate the level of electrolyte in the electrolytic bath, said material having an electrical conductivity greater than said cathode blade, and wherein the electrical resistance of the electrically conductive material on the exposed portion of the cathode plate above the electrolyte is reduced yielding a reduction in power consumption.

23. A method as claimed in claim 22, wherein said quantity of electrically conductive material is applied electrolytically to the cathode plate.

24. A method as claimed in claim 22, wherein the quantity of electrically conductive material extends to a position about 30 to 40 mm above the level of electrolyte when the cathode plate is placed in the electrolytic bath.

25. A method as claimed in claim 22, wherein the electrically conductive material is 2 to 4 mm thick.

26. A method as claimed in claim 22, wherein the electrically conductive material is copper.

* * * * *